US006341836B1

(12) United States Patent
Koike et al.

(10) Patent No.: US 6,341,836 B1
(45) Date of Patent: Jan. 29, 2002

(54) WATER-REPELLENT COATING AND METHOD FOR FORMING SAME ON THE SURFACE OF LIQUID JET

(75) Inventors: Shuji Koike, Kawasaki; Masayuki Sasaki, Inagi; Tomoyuki Akahoshi, Kawasaki, all of (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 09/484,036

(22) Filed: Jan. 18, 2000

(30) Foreign Application Priority Data

Mar. 17, 1999 (JP) ..... 11-071202

(51) Int. Cl.[7] ..... B41J 2/135
(52) U.S. Cl. ..... 347/20
(58) Field of Search ..... 347/20, 44, 45, 347/46, 47; 428/446

(56) References Cited

U.S. PATENT DOCUMENTS 5,502,470 A * 3/1996 Miyashita et al. ..... 347/45
5,863,371 A 1/1999 Takemoto et al.
5,919,572 A * 7/1999 Blum et al. ..... 428/446

FOREIGN PATENT DOCUMENTS

| | | |
|---|---|---|
| EP | 0 506 128 A1 | 9/1992 |
| JP | 56-166085 A | 12/1981 |
| JP | 59-47399 A | 3/1984 |
| JP | 59-106918 A | 6/1984 |
| JP | 59-176054 | 10/1984 |
| JP | 4-339662 A | 11/1992 |
| JP | 5-4344 A | 1/1993 |
| JP | 5-193140 A | 8/1993 |
| JP | 6-246921 A | 6/1994 |
| JP | 6-344560 | 12/1994 |
| JP | 7-171964 A | 7/1995 |
| JP | 8-142334 A | 6/1996 |
| JP | 8-244233 | 9/1996 |
| JP | 9-076492 A | 3/1997 |
| JP | 09104109 | 4/1997 |
| JP | 9/-31880 A | 5/1997 |

OTHER PUBLICATIONS

Patent Abstracts of Japan, vol. 1999, No. 03 (Mar. 31, 1999) & JP 10 323984 A (Dec. 8, 1998) translation *abstract*.
Patent Abstracts of Japan, vol. 1995, No. 03 (Apr. 28, 1995) & JP 06 344560 A (Dec. 20, 1994) *abstract*.
Patent Abstracts of Japan, vol. 014, No. 052 (Jan. 30, 1990) & JP 01 280566 A (Nov. 10, 1989) *abstract*.
Patent Abstracts of Japan, vol. 012, No. 197 (Jun. 8, 1988) & JP 63 003963 A (Jan. 8, 1988) *abstract*.

* cited by examiner

*Primary Examiner*—Ana T. N. Vo
(74) *Attorney, Agent, or Firm*—Armstrong, Westerman, Hattori, McLeland & Naughton, LLP

(57) ABSTRACT

A water-repellent coating having a higher wiping resistance against a wiper and capable of being formed by a more simplified process than was previously possible. The method of forming the water-repellent coating comprises a flat hard body and a plating-processed fluoric polymer which are formed on a nozzle plate having a nozzle as a substrate around the nozzle.

10 Claims, 7 Drawing Sheets

WATER-REPELLENT COATING AND METHOD FOR FORMING SAME ON THE SURFACE OF LIQUID JET

BACKGROUND OF THE INVENTION

The present invention relates to compositions of water-repellent coatings on the surface of liquid jet nozzles and in particular a nozzle plate for an inkjet printer.

Among inkjet heads, those using a piezo-electric element have recently become more and more popular for their high energy-efficiency, etc. This kind of inkjet head typically comprises a piezo-electric element, one common ink chamber with ink supplied from outside and stored therein, a plurality of pressure chambers connected to the piezo-electric element and a nozzle plate connected to the pressure chambers so that a nozzle is connected to each pressure chamber. Each pressure chamber that is connected each corresponding ink feed path to the common ink chamber receives ink from the common ink chamber, increases an internal pressure by utilizing a deformation of the piezo-electric element, and thereby jets ink from the nozzle.

On the surface of the nozzle plate (opposite to the pressure chamber) a water-repellent coating is typically formed around the nozzle. The water-repellent coating has the following exemplary effects. First, the water-repellent coating serves to stabilize a flying direction of ink jetted from the nozzle. Without the water-repellent coating, onto the nozzle plate surface is adhered the ink spouted from the pressure chamber, the ink adhered onto the nozzle plate like this pulls the next ink jetted continuously, and thereby bends the flying direction of ink and prevents from flying straight in a desired direction. Secondly, the water-repellent coating serves to smooth a wiping process. After a printing operation is completed, the inkjet head usually undergoes a backup process that eliminates dirt from the nozzle. In the backup process, a suction pump contacts the nozzle and sucks out dirt therein, and at the same time the ink in the nozzle adheres onto the surface of the nozzle plate. Thus, the wiping process that a wiper such as rubber blade, etc. wipes ink on the nozzle surface follows. In that event, without the water-repellent coating, the ink adhered onto the nozzle plate surface after the backup process could not successfully be wiped out and would remain on the nozzle plate surface. Consequently, the subsequently flying direction of ink is bent and printing quality is adulterated with impure or diluted color if the remaining ink is different in color from the subsequently flying ink.

For the forgoing effects, it is inevitable for inkjet head to form the water-repellent coating. In addition, a conventional water-repellent coating has a fluoric polymer of high water repellency as a main ingredient.

However, the fluoric polymer is soft and less adhesive to a substrate, and thus is likely to flaw, abrasion or scratch (i.e. low wiping-resistant); therefore, its anticipated water repellency can not be continuously maintained. Accordingly, it has been desired to form a water-repellent coating that has a fluoric polymer as a main ingredient and is continuously usable about one hundred thousand times.

Conventionally, it has been suggested for example that a fluoric polymer is plated and a subsequent heating process melts the fluoric polymer adhered onto the plated surface, forms a coating and thereby improves its wiping resistance. This process, however, involves a problem that the coating, even if it is formed, is worn out shortly by a plural of frictions and its water repellency lowers. On the other hand, it has also been suggested to form a member around the liquid jet in concave shape and avoid the fluoric coating around the nozzle from scratched by a friction. The unleveling process, however, increases its person-hours and costs.

BRIEF SUMMARY OF THE INVENTION

Accordingly, it is a general object of the present invention to provide a novel and useful water-repellent coating and method of forming the water-repellent coating in which the above disadvantages are eliminated.

More specifically, it is an exemplified object of the present invention to provide a water-repellent coating that has higher wiping resistance relative to a wiper and is formed by a more simplified process than was previously possible, and a method of forming such a water-repellent coating.

In order to achieve the above object, a print head according to claim 1 comprises a nozzle plate having a nozzle which jets ink, and a water-repellent coating that is formed on the nozzle plate as a substrate around the nozzle and comprises a hard body and a fluoric polymer formed by a plating process. According to the print head claimed in claim 1, water repellency of the fluoric polymer works against liquid like ink, etc. jetted from the nozzle, and the hard body enhances wiping resistance of the fluoric polymer.

A print head as set forth in claim 2 that depends upon claim 1 comprises a water-repellent coating including the hard body in a flat shape. Thus, according to the print head claimed in claim 2, the hard body is less likely to fall off than a spherical shaped one and serves to maintain wiping resistance for a long time. A print head as set forth in claim 3 that depends upon claim 1 comprises a water-repellent coating including the hard body having a major axis of 1 $\mu$m or smaller in its particle diameter. According to the print head claimed in claim 3, the hard body having a big particle diameter never prevents a nozzle plate surface from being smoothly wiped. A print head as set forth in claims 4 and 5 that depends upon claim 1 comprises a water-repellent coating having the hard body including a boron nitride boron nitride single crystal. Therefore, according to the print head claimed in claims 4 and 5, the boron nitride or boron carbide single crystal intrinsically having the advantage of a flat shape requires no additional process to deform the hard body into a flat shape. A print head as set forth in claims 6 and 7 that depends upon claim 1 comprises a water-repellent coating employing an electrolytic or electroless plating process as the plating process. Accordingly, the print head claimed in claims 6 and 7 has the advantage of requiring no special plating process.

A recording device as set forth in claim 8 comprises a print head and a driving device which drives the print head wherein the print head includes a nozzle plate having a nozzle which jets ink and a water-repellent coating which is formed on the nozzle plate as a substrate around the nozzle and comprises a hard body and a fluoric polymer formed by a plating process. According to the recording device claimed in claim 8, water repellency of the fluoric polymer works against liquid like ink, etc. jetted from the nozzle, and the hard body enhances wiping resistance of the fluoric polymer.

A method of forming a water-repellent coating as set forth in claim 9 comprises the steps of forming on a nozzle plate a first resist which is open only around a nozzle of the nozzle plate, forming a first layer of a plated fluoric polymer by a first plating process via the first resist, forming a second resist, adding a hard body to a first layer by a second plating process, and removing the first and second resists. According to the method of forming a water-repellent coating claimed in this claim, the hard body is allowed to protrude from the water-repellent coating surface because the water-repellent coating is formed on the nozzle plate as a substrate. A method claimed in claim 10 that depends on claim 9 further comprises the step of heating the water-repellent coating until its water repellency becomes enough to make a contact angle of ink containing 10% of alcohol 60 degrees or larger. By the heat treatment, the fluoric polymer melts and taking in the additive hard body.

Other objects and further features of the present invention will become readily apparent from the following description and accompanying drawings.

DETAILED DESCRIPTION OF THE INVENTION

Figure 1:
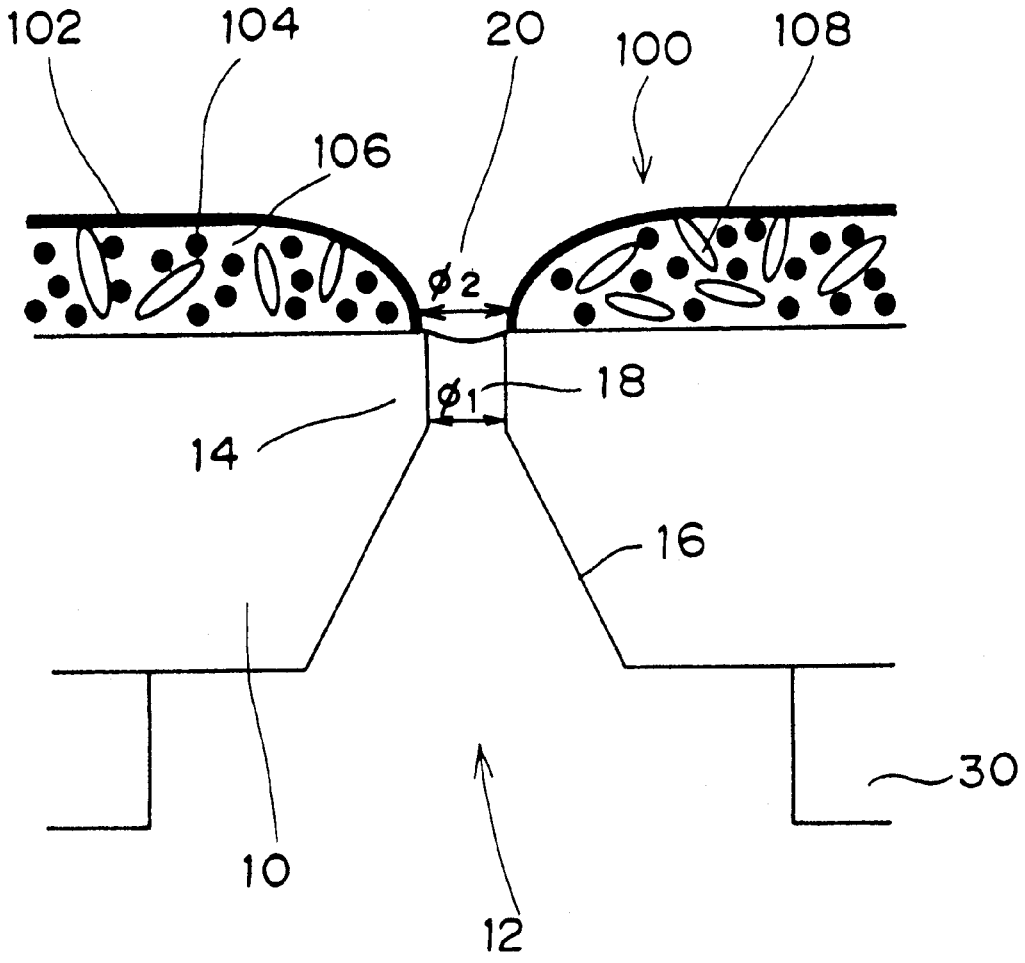
FIG. 1 is a schematic sectional view for explaining a composition of a water-repellent coating of the present invention.
Figure 2:
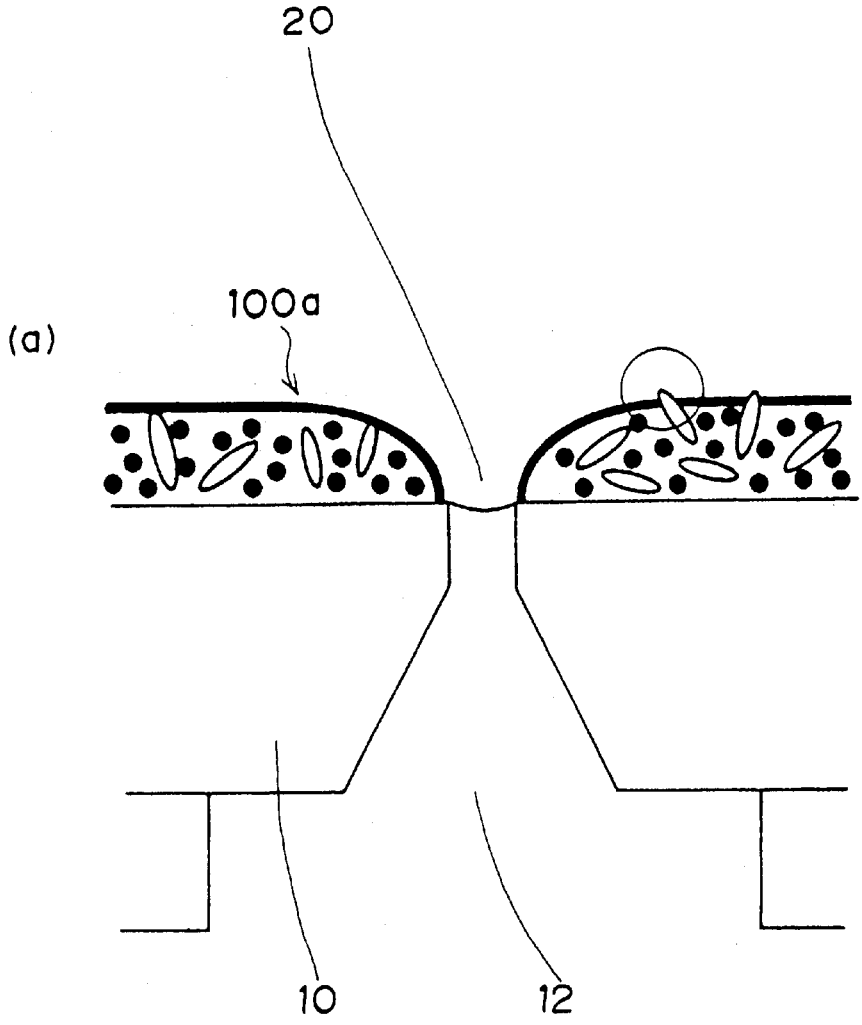
FIG. 2 is a schematic sectional view illustrating a variation of the water-repellent coating shown in FIG. 1 or a state after a predetermined period of use.
Figure 3:
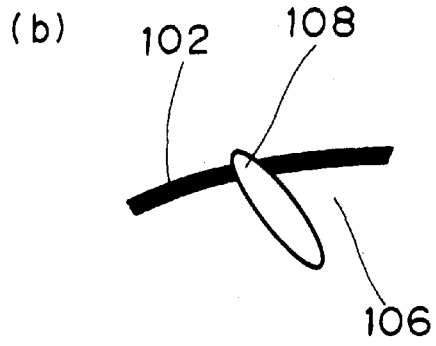
FIG. 3 is an enlarged view of a portion circled in a solid line in FIG. 2.

Referring now to FIGS. 1 to 3 inclusive, a description will be given of a water-repellent coating 100 according to the present invention. FIG. 1 is a schematic sectional view for explaining a composition of a water-repellent coating 100 of the present invention. FIG. 2 is a schematic sectional view of a water-repellent coating 100*a* showing an exemplified variation or a state after a predetermined period of use. FIG. 3 is an enlarged view of a portion circled in a solid line in FIG. 2. In each drawing, those elements designated by the same reference numeral denote the same elements, and a duplicate description thereof will be omitted. Those elements designated by the same reference numeral with a variety of alphabetical letters attached thereto denote the same kinds of elements but are distinguished from each other by alphabets and are comprehensively designated by simple reference numerals.

The water-repellent coatings 100 and 100*a* are, for example, 1 through 2 $\mu$m thick and are formed around a nozzle 12 on the surface of a nozzle plate 10. FIG. 1 is an enlarged sectional view around a nozzle (hole) 12 applicable to a print head 300 which will be described later (e.g. piezo-type inkjet head and a bubble jet-type inkjet head). The nozzle plate 10 comprises the nozzles 12 each having a straight portion 14 and a taper portion 16, to the number corresponding to a predetermined resolution. The nozzle 12 does not necessarily include both of the straight portion 14 and the taper portion 16 but may include only one of them. A portion defined by the straight portion 14 is an opening portion 18 of the nozzle 12 where a meniscus 20 of ink is formed. The nozzle plate 10 is connected to a pressure chamber plate 30, and the pressure chamber plate 30 is provided with an ink chamber as will be described later.

The water-repellent coatings 100 and 100*a* comprise a fluoroplastic coating 102, a fluoroplastic particle 104, a nickel base 106 and a flat hard body 108. The water-repellent coating 100 shown in FIG. 1 is different from the water-repellent coating 100*a* shown in FIG. 2 in whether the flat hard body 108 is partially protruded from the fluoroplastic coating 102.

The water-repellent coatings 100 and 100*a* are characteristically formed on the nozzle plate 10 as a substrate. Therefore, this invention does not adopt such a method, for example, that the water-repellent coating and the nozzle plate 10 are formed in this sequence on a plane and then the plane is removed. Because this method makes the hard body 108 unable to protrude from the fluoroplastic coating 102 as shown in FIG. 2. A projection structure of the hard body 108 as shown in FIG. 2 is suitable for preventing the fluoroplastic coating 102 from being scratched by a friction of a wiping blade (wiper) and making it possible to maintain ink water repellency for a long period.

For the fluoroplastic coating 102 and the fluoroplastic particle 104, tetrafluoroethylene resins, tetrafluoroethylene-hexafluoropropylene copolymerization resins, trifluoroethylene chloride resins, fluorovinylidene resins, fluorovinyl resins, PTFE, FEP, ETFE, PFA, PCTFE and PVDF are usable either singly or in the form of a mixture of two or more of them. Their average particle diameters should preferably be less than 150 $\mu$m and in particular ranging from 0.05 to 20 $\mu$m. In addition to the above fluoroplastic particles, as needed, other inorganic or organic precipitation polymer particulates may be formed together.

The nickel base 106 as a plating coating is added to improve adhesion. Other than nickel may be employed copper, silver, zinc, tin, cobalt and such nickel alloys as a nickel-cobalt alloy, a nickel-phosphorus alloy and a nickel-boron alloy, etc. The plating coating can be formed, for instance, by using the electrolytic plating solution or electroless plating solution in which PFA is suspended. The electrolytic plating solutions according to a variety of metal plating coatings to be deposited may be selected from an electrolytic nickel plating solution such as the Watts bath, a chloride-rich bath, a nickel sulfamate bath and a nickel borofluoride bath, etc.; an electrolytic cobalt plating solution such as a cobalt sulfate bath and a cobalt chloride bath, etc.; an electrolytic copper plating solution such as a copper sulfate bath and a copper borofluoride bath, etc.; an electrolytic lead/tin plating solution such as a lead sulfate bath, a tin sulfate bath and a lead borofluoride bath, etc. It is however preferable to employ a sulfamic acid bath having a sulfamic acid ion content of more than 0.5 mol, more desirably more than 0.8 mol especially in the light of their properties that form more precipitation and resist agitation. The electroless plating solutions may be selected from an electroless nickel plating solution, an electroless cobalt plating solution and an electroless copper plating solution, etc. using a boron compound such as a hypophosphate and a dimethyl borazon, etc. as a reducing agent.

Figure 4:
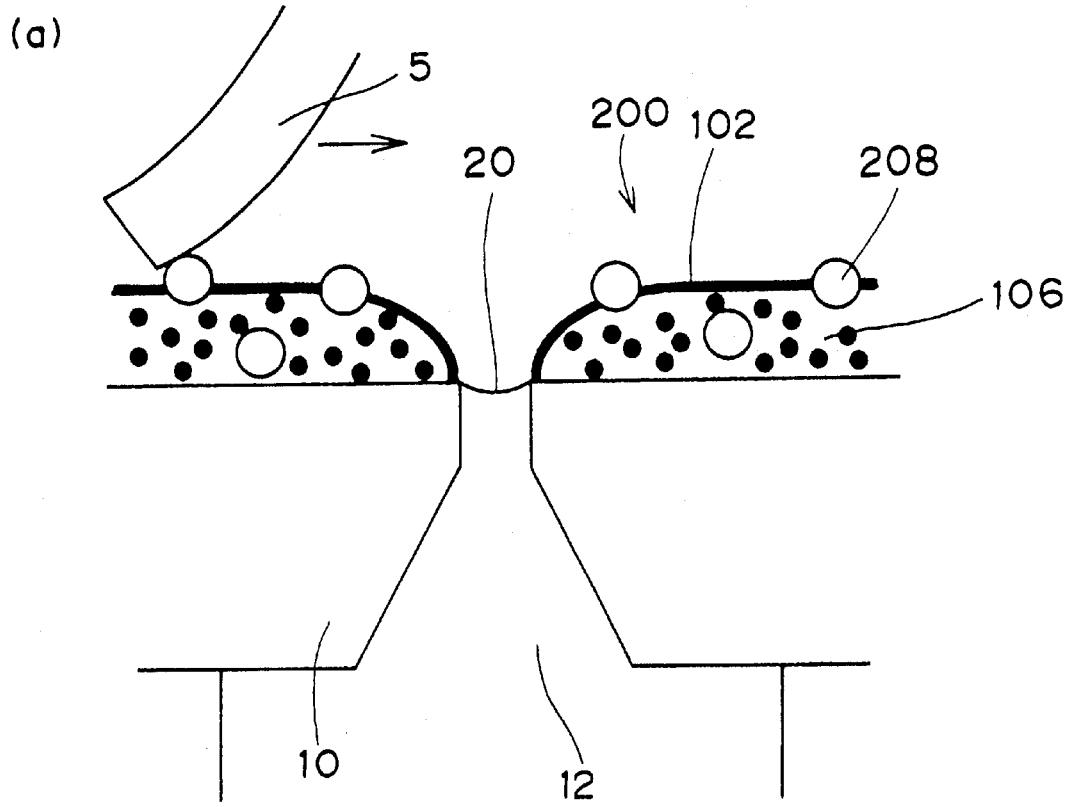
FIG. 4 is an aschematic sectional view for explaining a composition of a water-repellent coating having a spherical hard body relative to the water-repellent coating in FIG. 1 having a flat hard body.
Figure 5:
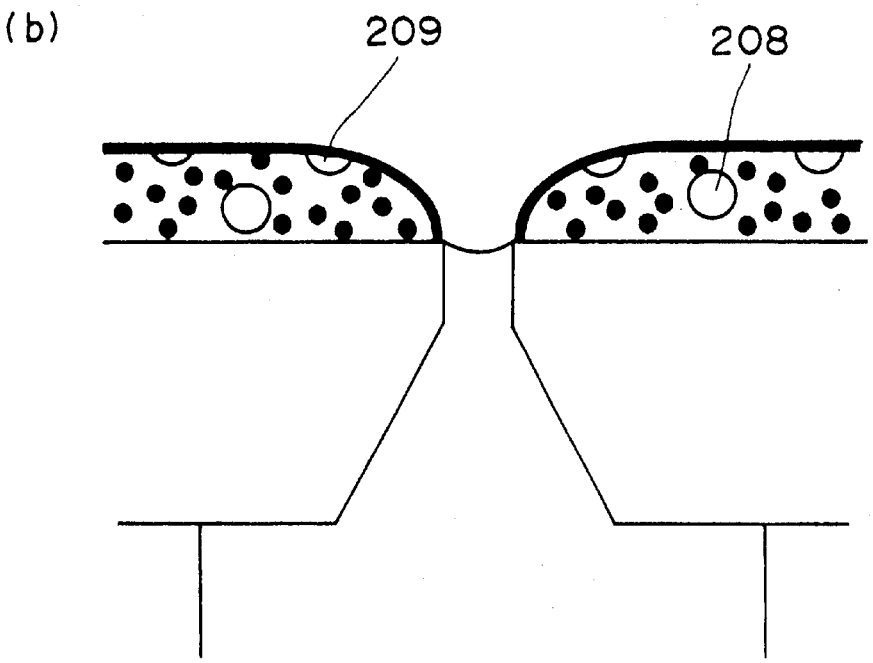
FIG. 5 is a schematic sectional view for explaining a state in which the spherical hard body in FIG. 4 is fallen down.

The hard body 108 has a higher hardness than a fluoric polymer and a flat shape. The hard body 108 should preferably be as water-repellent, wiping-resistant and frictionless as possible. Even though the hard body 108 has low water repellency, a heat treatment as will be described later melts the fluoric polymer, covers the hard body 108, and thereby maintains the water repellency. The hard body 108 is added so as to promote the wiping resistance of the fluoric polymer against the wiper. Its flat shape aims at enhancing an anchor effect into the plating coating. A more specific description is now given to the enhanced anchor effect. To illustrate, suppose that a spherical hard body 208 (e.g. having more than 1 $\mu$m in diameter) is dispersed in the water-repellent coating 200 (e.g. of about 1 $\mu$m in thickness), as shown in FIG. 4. If the water-repellent coating 200 is wiped on its surface by a wiper 5, the spherical hard body 208 other than having more than half of its diameter embedded in the water-repellent coating 200 is fallen down as shown in FIG. 5, so that the wiping resistance of the water-repellent coating lowers to such a level as that of the water-repellent coating having no hard body 208. In FIG. 5, a mark left by the hard body 208 is indicated with 209.

As the hard body 108, are usable, for example, BN (boron nitride), boron carbide, silicon carbide, titanium carbide, tungsten carbide, graphite fluoride, alumina, glass and ceramics, etc. The boron nitride and boron carbide are suitable for the water-repellent coating of this invention in that they are dealt with in a single crystal and the single crystal is not spherical in crystal structure (the boron nitride is flat). Particularly, the boron nitride, which is used for reducing friction of a bearing, is suitable for improving sliding properties of the electroless nickel coating and increasing strength of the fluoroplastic coating 108. When the alumina, glass, ceramics are used, they should be deformed in a flat shape. BN added for this is, for example, some 5 g/l or 10 g/l, preferably 20 g/l.

Since the additive hard body 108 is less water-repellent than the fluoric polymer, the water-repellent surface should be covered as widely with the fluoric polymer as possible. Therefore, it is necessary to increase a water-repellent portion of liquid contact surface by heating and melting the fluoric polymer after plated so as to taking in the additive.

Referring now to FIG. 6A–FIG. 6E, a description will be given of a method of manufacturing a nozzle plate with a water-repellent coating as shown in FIGS. 1 and 2. Hereupon, FIG. 6A–FIG. 6E are flow sectional diagrams for explaining one exemplified method of the water-repellent coating 100 shown in FIG. 1 or the water-repellent coating 100*a* shown in FIG. 2. First, as shown in FIG. 6(A), a nozzle plate substrate 10 of a stainless steel (SUS316) plate of 100 $\mu$m through 300 $\mu$m thickness is processed by stamping, etching, electrical discharge machining and laser machining, etc. and is provided with a nozzle 12. To illustrate, assume that a conic nozzle 12 is made by stamping, a straight portion 14 being 40 $\mu$m thick and 20 $\mu$m length, and a taper portion 16 has a taper angle of 20 degrees. A nozzle plate surface 22 is roughly ground to remove burrs left by the processing but the burrs are not completely removed.

Next, as shown in FIG. 6(B), corrosion-resistant polymer resin as a resist is filled in the processed nozzle 12. A photosensitive liquid resist is usable as a resin member in contemplation of its subsequent removal and its machinability. This example utilizes a dry film resist (DFR) 24 of a curing acrylic resin. The DFR 24 becomes a viscid liquid by adding a sufficient heat and is easily filled in the nozzle 12. Further, in terms of removal, water soluble DFR which may be easily removed with alkaline water solution is available.

As shown in FIG. 6(C), the nozzle plate surface 22 is drenched in a stainless etching solution and etched. On the nozzle plate surface 22 there exist burrs left by the processing or rough grinding of the nozzle 12, but can easily be removed by etching process. This makes it possible to omit a final finishing grinding step in processing the nozzle plate 10, and enables a cost-reduction. In addition, a chemical grinding means, if used, may reduce a mechanical stress applied to the nozzle substrate 10 and may improve processing accuracy. The etching depth is 10 $\mu$m and the length of straight portion 14 is 10 $\mu$m.

Thereafter, a water washing, an electrolytic defatting, a water washing, an acid washing and a strike Ni plating are processed, and a water-repellent coating 100 is formed on the nozzle plate surface 22 with a Ni precipitation plating as shown in FIG. 6(D). The water-repellent coating 100 has the thickness not exceeding the height of the protruded DFR 24. Then, the nozzle plate 10 is drenched in an alkaline water solution, the DFR 24 is removed as shown in FIG. 6(E), and the nozzle plate 10 with a water-repellent coating 100 becomes completed. When materials as having difficulty in being etched, such as ceramics, glass, etc. are used as the nozzle plate 10, the grinding process (FIG. 6(C)) may be substituted by a physical means using a sandblast. In that event, a sandblast-resistant DFR 24 that includes a polyurethane resin other than an acryl resin as usual ingredients (e.g. BF series made by Tokyo Ohka Kogyo Co., Ltd.) may be employed. The physical grinding means is also applicable to a nozzle plate substrate 10 made of metal.

Like this, the water-repellent coating 100 on the nozzle plate surface 22 by Ni precipitation plating is formed along a projected portion of DFR 24, preventing dropping into the nozzle 12, and maintains the size accuracy of the nozzle 12 and the water-repellent coating 100. For example, in FIG. 1, the water-repellent coating 100 is formed so that it permits dropping by making its diameter $\phi_2$ within 3% range of the diameter $\phi_1$ of an opening 18. This 3% difference is for the purpose of arranging the opening of the water-repellent coating 100 and the opening 18 of the nozzle plate on almost the same side. This arrangement can prevent a deviation of ink dots, stabilize flying ink direction and provide high quality images.

Figure 6:
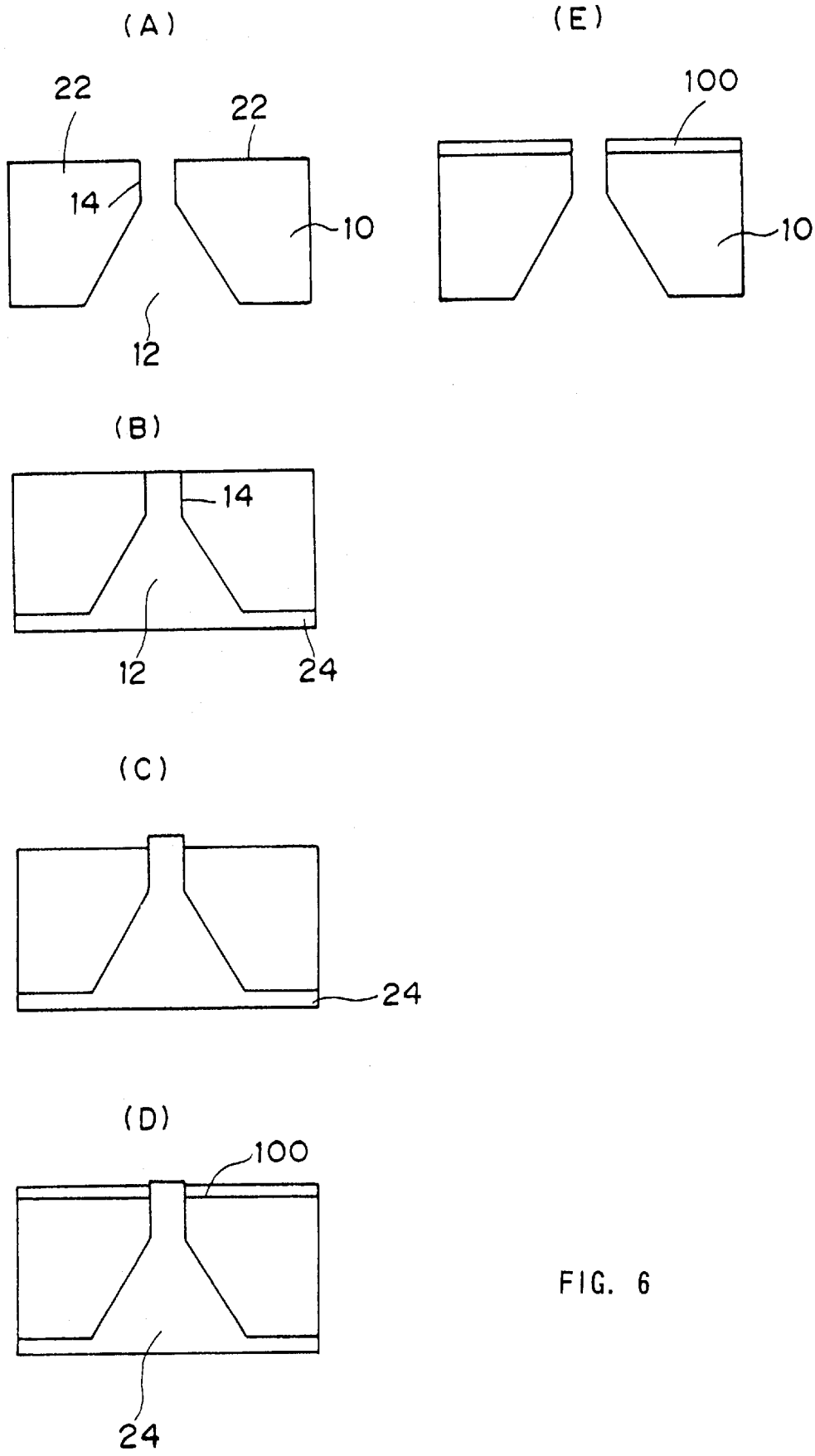
FIG. 6A–FIG. 6E are flow sectional diagrams for explaining one example of a method of forming the water-repellent coating shown in FIG. 1.
Figure 7:
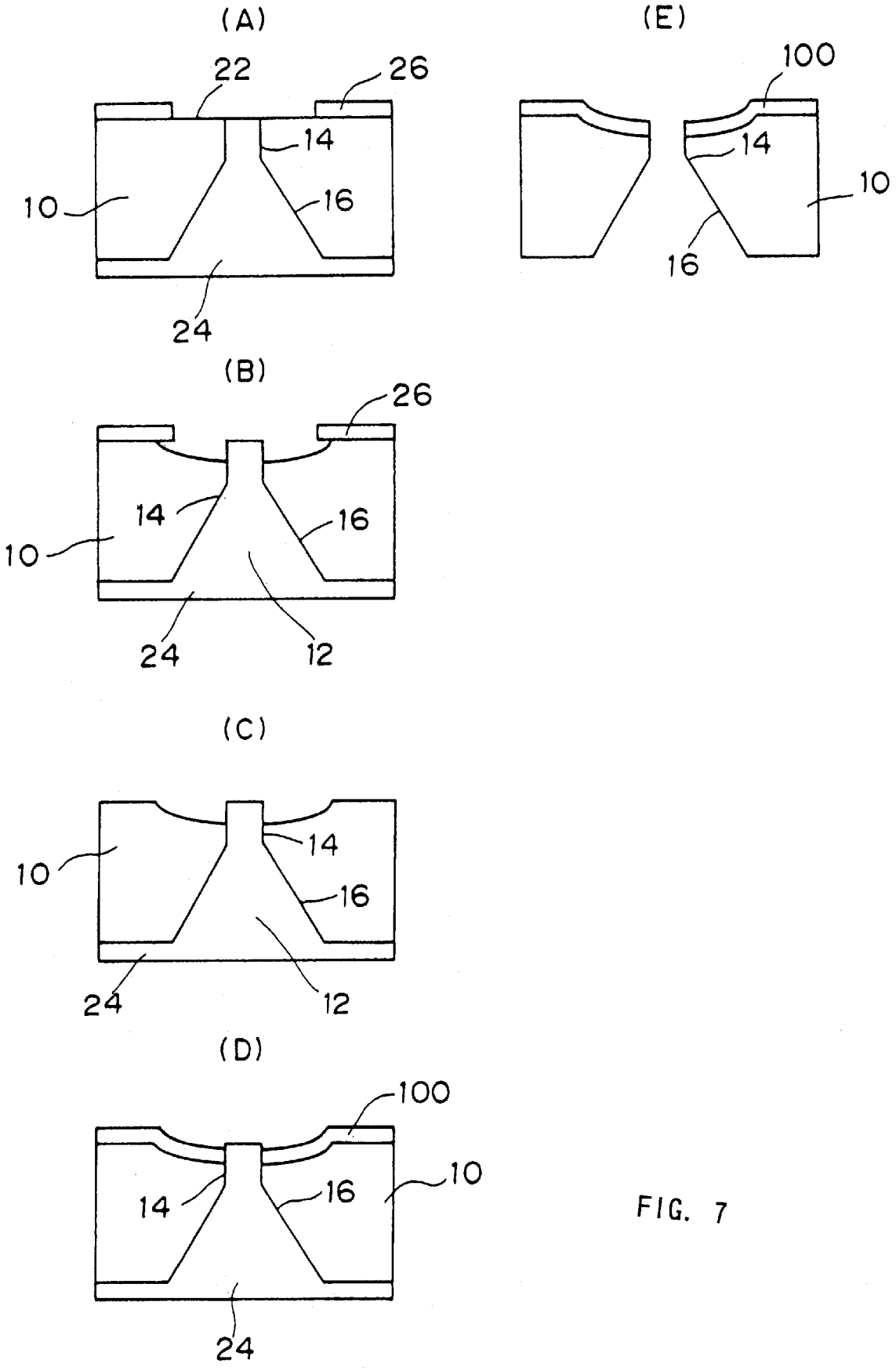
FIG. 7A–FIG. 7E are flow sectional diagrams for explaining another example of a method of forming the water-repellent coating shown in FIG. 1.

Referring next to FIG. 7A–FIG. 7E, a description will be given of another method of manufacturing the nozzle plate 10 having the water-repellent coating 100. The process shown in FIG. 7A–FIG. 7E, is a variation of the process of FIG. 6(C) and those that follow, and it is to be construed that the process indicated in FIG. 7(A) follows the process indicated in FIG. 6(B). As shown in FIG. 7(A), on the nozzle plate surface 22 is formed a liquid resist or a DFR coating 26 capable of alkaline development and removal, and then the exposure and development with a mask pattern eliminate coatings around the opening 18 on the nozzle plate surface 22. Next, as shown in FIG. 7(B), the nozzle plate substrate 10 is drenched in an etching solution and the surface of the opening the coating 26 is ground. The etching depth can be adjusted by altering etching conditions. By adjusting the depth, the length of the straight portion 14 and the projection amount of the DFR 24 are adjusted.

As shown in FIG. 7(C), the coating 26 is removed with strong alkaline solution. In this case, the DFR 24, which is an alkaline-resistant resist, is not eliminated and remains. After that, a water washing, an acid washing, an electrolytic defatting, a water washing and a strike Ni plating are processed. Subsequently, as shown in FIG. 7(D), Ni precipitation plating is processed on the nozzle plate surface 22 and the water-repellent coating 100 is formed. The coating thickness is so adjusted as does not exceed the projection amount of the DFR 24. Thereafter, as shown in FIG. 7(E), the DFR 24 are removed and eliminated with solution development-type resist removal solution.

The above manufacturing method can also provide a nozzle plate 10 having an accurate sized water-repellent coating 100, as in FIG. 6. This method, particularly as using DFR 24 as a resist member, only necessitates a heating process where an exposure process may be omitted, and is applicable at one step from the back of the nozzle plate substrate 10, whereby reducing manufacturing costs.

Description will be given of a method of manufacturing a water-repellent coating 100 shown in FIG. 1 or a water-repellent coating 100*a* shown in FIG. 2. First, in order to form a water-repellent plating coating only on the surface of the nozzle plate 10, other portions are masked so as not to adhere the coating. In this step, the nozzle plate 10 as a substrate is laminated at the side on which a pressure chamber 30 is formed with an alkaline development-type dry film (this exemplified embodiment utilizes α-450 made by Tokyo Ohka Kogyo Co., Ltd.) on conditions of 120° C., 2.5 kgf/cm, 0.5 m/min. This allows the dry film to break in to the taper portion 16 and the straight portion 14 of the nozzle 12. Moreover, the resist flows out of ink jet opening of the nozzle, covering a portion around the edge of the nozzle opening of a width of 1 μm, and then the resist is hardened by a double-sided exposure.

On the other hand, in order to form a water-repellent coating with a single crystal BN (boron nitride) added thereto, prepare a fluoroplastic containing Ni plating solution (made by Hikifune Co., Ltd.) to which a BN with longitudinal particle size of 1 μm or smaller (particles of more than 1 μm being crushed to this size) is added at the rate of 20 g/l and coat a water-repellent plating to the nozzle plate 10 masked as described above.

The nozzle plate 10, made of stainless steel (SUS430), is drenched in 10% hydrochloric acid for three minutes, washed in water to remove an oxidized coating and is strike Ni plated to improve its plating adhesion.

The specification of the strike Ni plating is as follows.

| | | |
|---|---|---|
| (1) | Bath composition | |
| | nickel chloride ($NiCl2.\ 6H_2O$) | 220 g/l |
| | hydrochloric acid (HCl 35%) | 45 g/l |
| (2) | Temperature | room temperature |
| (3) | Electrode | |
| | titanium basket (150 × 30 × 250 mm) | |
| | electrolytic nickel (ø 1B × 10 mm) | |
| (4) | Current density | 2 A/dm$^2$ |

After one-minute plating by using this strike Ni plating solution, the nozzle substrate is drenched in a water-washing bath and immediately commences a water-repellent plating process. The specification of the water-repellent plating is as follows.

| | | |
|---|---|---|
| (1) | Solution composition | |
| | nickel sulfamate | 420 through 480 g/l |
| | nickel chloride | 40 through 50 g/l |
| | boric acid | 30 through 40 g/l |
| | PTFE | 40 through 50 g/l |
| | BN | 20 g/l |
| | PH | 4.0 through 4.4 |

-continued

| | | |
|---|---|---|
| (2) | Temperature | 42° C. |
| (3) | Electrode | |
| | titanium basket (150 × 30 × 250 mm) | |
| | electrolytic nickel (ø 1B × 10 mm) | |
| | diaphragm | |
| (4) | Current density | 2 A/dm$^2$ |

The nozzle substrate is plated for three minutes by using this water-repellent plating solution. After washed in water, it is drenched in a NaOH (3 wt %) solution, removes a resist, and then after water washing and drying processes, makes PTFE into a coating adhered as a plating by a heating process at 350° C. for thirty minutes. The plated coating, as shown in a photograph attached herewith, has BN particles scattered thereon, whereby preventing a convex portion of the BN particles from being scratched even though an outermost fluoric coating is scratched by friction and abrasion of a wiper (rubber blade), so that a water-repellent effect can be maintained.

Figure 8:
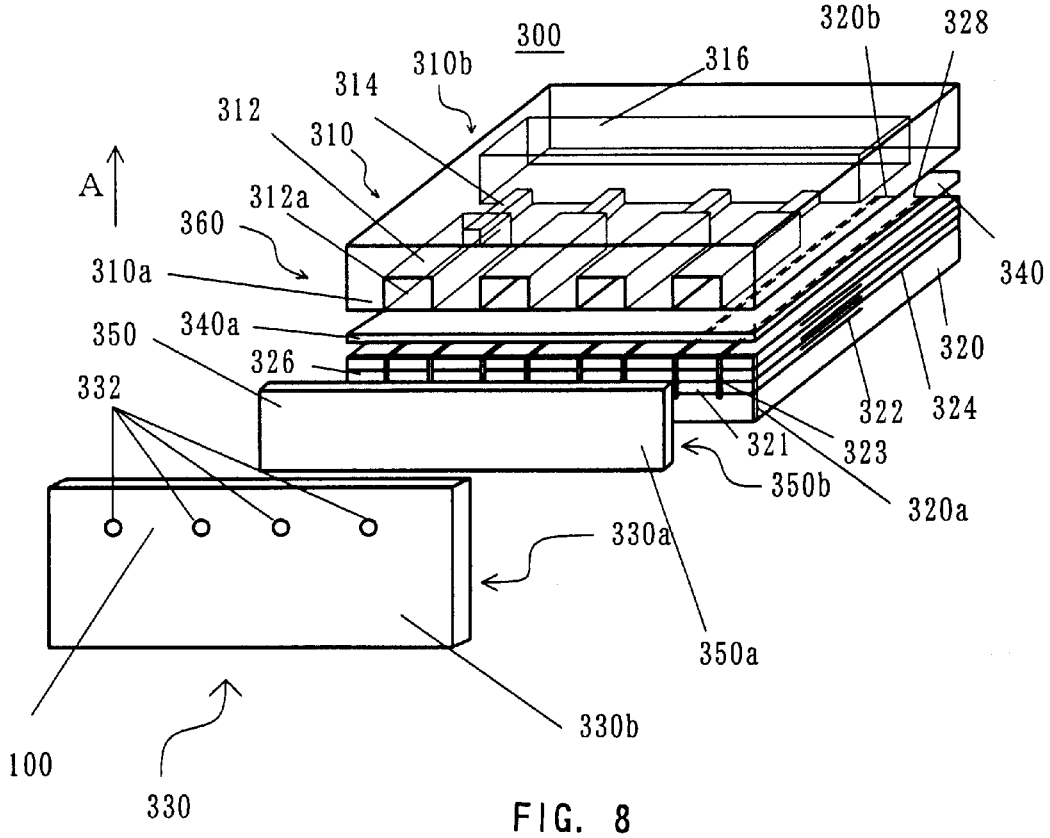
FIG. 8 is an exploded perspective view of a completed inkjet head 300.
Figure 9:
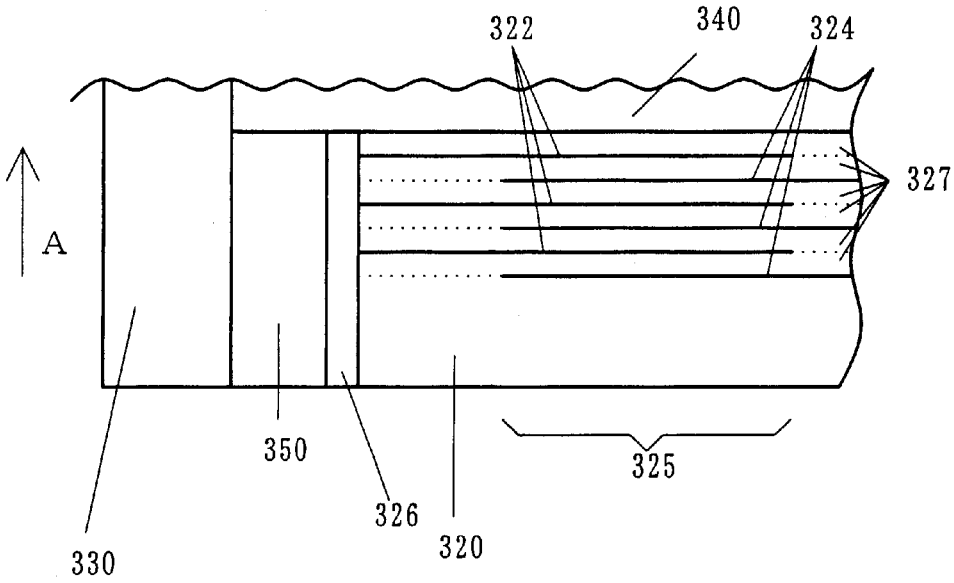
FIG. 9 is a partially enlarged side view of an inkjet head 300.

Referring next to FIGS. 8 and 9, a description will be given of an inkjet head 300 of the present invention. FIG. 8 is an exploded view of the completed inkjet head 300 and FIG. 9 is a partially enlarged side view of the inkjet head 300. As seen from FIG. 8, the inkjet head 300 of the present invention comprises a pressure chamber plate 310, a piezo-electric element 320, a nozzle plate 330, a resin film 340 and a protective layer 350. The nozzle plate 330 corresponds to the nozzle plate 10 shown in FIG. 1 and the pressure chamber plate 310 corresponds to the pressure chamber plate 30 shown in FIG. 1. The pressure chamber plate 310, the resin film 340 and the protective layer 350 are aligned with each other at a nozzle connection surface 360 that is a surface to which a surface 330*a* of the nozzle plate 330 is connected. In other words, the front surface 310*a* of the pressure chamber plate 310, a front surface 340*a* of the resin film 340 and a front surface 350*a* of the protective layer 350 form the flat nozzle connection surface 360.

The pressure-chamber plate 310 has the desired number (four in FIG. 8 for description purposes) of pressure chambers 312 and ink introduction channels 314 and a common ink chamber 316 in an approximately rectangular parallelepiped glass plate. Each pressure chamber 312 receives and accommodates ink, and jets the ink from a nozzle 332 connected to an opening 312*a* as its internal pressure increases. The internal pressure changes according as the piezo-electric block 321 just under the pressure chamber 312 deforms, as will be described later. The pressure chamber 312 is formed as an approximately rectangular parallelepiped space by a concave groove on the pressure chamber plate 310 and the elastically deformable resin film 340. The common ink chamber 316 supplies ink to each pressure chamber 312 via the corresponding ink introduction channel 314. A bottom of the common ink chamber 316 is defined by the resin film 340 so as to absorb sudden internal pressure changes, and connected to an ink feed device (not shown) at a side surface 310*b* of the pressure chamber plate 310. The common ink chamber 316 supplies a necessary amount of ink to the pressure chamber 312 via the ink introduction channel 314 when the pressure chamber 312 returns to the original state after the chamber 312 contracts, receives pressure and jets ink.

The resin film 340 defines one surface of each of the pressure chambers 312, the common ink chamber 316 and each of the ink introduction channels 314, and serves to transmit a deformation of each piezo-electric block 321 which will be described later to the corresponding pressure chamber 312 and to prevent ink in the pressure chamber 312 from penetrating into grooves 323 in the piezo-electric element 320. The resin film 340 is, for example, approximately 16 μm thick and the order of Gpa adhesive. The resin film 340, which is a member that forms one surface of the pressure chamber 312, may be replaced with an elastic metal thin film.

The piezo-electric element 320 has layered structure having a plurality of (four in FIG. 1 for description purposes) piezo-electric blocks 321 which are divided by parallel grooves 323 which extend from a front surface 320*a* to a rear surface 320*b*. Internal electrodes 322 and 324 are provided between layers of piezoelectric blocks 321, and the internal electrode 322 is connected to an external electrode 326 and the internal electrode 324 is connected to an external electrode 328. FIG. 8 shows only one external electrode 328 for illustration purposes. As shown in FIG. 9, an active area 325 is a portion where the internal electrodes 322 and 324 overlap each other in direction A, and each piezo-electric block 321 deforms in the active area 325. The length of each active area 325 is adjustable depending upon a pressure to be applied to the pressure chamber 312. Since the active area 325 is spaced at a predetermined distance from the nozzle connection surface 360, even when the piezo-electric blocks 321 deform, such deformation does not affect the adhesion between the piezo-electric element 320 and the protective layer 350 at the nozzle connection surface 360.

The external electrode 326 is an electrode layer that is evaporated onto an entire surface of the front surface 320*a* of the piezo-electric element 320, and an external electrode commonly used for all the piezo-electric blocks 321. The external electrode 326 is grounded. On the contrary, the external electrode 328, which is provided on the rear surface 320*b* of the piezo-electric element 320, is however an electrode layer which is not evaporated onto an entire surface of the rear surface 320*b* and is independently provided only on a portion corresponding to each piezo-electric block 321. The external electrode 328 has no potential unless electrified, but may apply a positive voltage to the internal electrode 324.

Due to such a structure, each piezo-electric block 321 of the piezo-electric element 320 does not deform when no voltage is applied to the external electrode 328, since both potentials of the internal electrodes 322 and 324 remain zero. On the other hand, when a voltage is applied from the external electrode 328, each piezo-electric block 321 may deform in the direction A (longitudinal direction) in FIG. 8, independent of the other piezo-electric blocks 321. In other words, the direction A is the polarization direction of the piezo-electric blocks 321. When the electrification to the external electrode 328 stops, that is, when the piezo-electric element 320 is discharged, the corresponding piezo-electric block 321 returns to the original state.

The piezo-electric element 320 of this embodiment is made of a plurality of green sheets 327. Each green sheet 327 is blended with solvents such as a ceramic powder, etc., kneaded into a paste and then formed to be a thin film having a thickness of about 50 μm by a doctor blade.

Among these green sheets, a pattern of the internal electrode 322 is printed and formed onto one surface of each of three green sheets, a pattern of the internal electrode 324 is printed and formed onto one surface of each of another three green sheets, and no internal electrode is formed onto the remaining sheets. Each of the internal electrodes 322 and 324 is printed by blending alloy powder of silver and palladium with a solvent into a paste to apply for its pattern formation.

Then, the three sheets including the internal electrode 322 and the three sheets including the internal electrode 324 are alternately stuck together, and thereafter the remaining six sheets are also stuck together. Thereby, the layered structure of the piezo-electric element 320 is formed as shown in FIG. 9. The green sheets that include none of the internal electrode 322 or 324 are stuck at a lower portion (in FIG. 9) of the piezo-electric element 320 and form a base part. These layered green sheets are sintered. Then, at least six sheets are partially cut by a diamond cutter from the front surface 320*a* to the rear surface 320*b*, whereby a plurality of the piezo-electric blocks 321 divided by the grooves 323 is formed. Lastly, the external electrodes 326 and 328 are formed by vacuum evaporation at the front surface 320*a* and the rear surface 320*b*. It is possible to form the grooves 323 before sintering. The completed piezo-electric element 320 is submitted to a characteristic test by applying a voltage to the external electrodes 326 and 328, and malfunctioning ones are eliminated.

The inkjet head 300 shown in FIG. 8 further comprises the protective layer 350. The protective layer has useful effects as will be explained later, but there is a choice whether the protective layer is provided.

The protective layer 350 is a thermosetting epoxy adhesive member having an approximately rectangular parallelepiped shape with a thickness of about 50 μm, and connected via a surface 350*b* to the front surface 320*a* of the piezo-electric element 320 (external electrode 326). The materials for the protective layer 350, however, are not limited to this type. For example, an epoxy filler member, an acrylic resin, a polyethylene resin or the like are usable for the protective layer 350. The protective layer 350 in the actual inkjet head 300 does not have a rectangular parallelepiped shape in the strict sense of the term, and an interface between the protective layer 350 and the piezo-electric element 320 is not clear or simple as shown in FIGS. 8 and 9 by the external electrode 326 and the surface 350*b*. The protective layer 350 partially penetrates through the grooves 323 into the piezo-electric element 320 before heatedly solidifying. Accordingly, it is preferable that the protective layer 350 is made of insulators so as to prevent a short circuit of the internal electrodes 322 and 324. The protective layer 350 of this embodiment is applied to the piezo-electric element 320 (external electrode 326) all over the front surface 320*a*, but may, if necessary, be applied partially.

The protective layer 350 spaces the piezo-electric element 320 about 50 μm apart from the nozzle connection surface 360. If ink leaked from the pressure chamber 12 and penetrated into the piezo-electric element 320, the ink would penetrate into the piezo-electric element 320 mainly along the nozzle connection surface 360. However, the protective layer 350 spaces from the nozzle connection surface 360 the piezo-electric element which has been conventionally located on the nozzle connection surface 360, and thereby prevents the ink from penetrating into the piezo-electric element 320 and short-circuiting the internal electrodes 322 and 324.

Moreover, the protective layer 350 shields the grooves 323. If ink leaked and penetrated into the piezo-electric element 320, the ink would penetrate mainly from an opening 312*a* of the pressure chamber 312, running along the nozzle connection surface 360, through the grooves 323 into the piezo-electric element 320. However, the protective layer 350 does shield the grooves 323 against or from the nozzle connection surface 360, and thereby prevents the ink from penetrating into the groove 323 from somewhere in the neighborhood of the front surface 320*a* of the piezo-electric element 320 and short-circuiting the internal electrodes 322 and 324.

In addition, the protective layer 350 also has the effect of protecting the piezo-electric element 320 from being destroyed by polishing in a polishing process for forming the nozzle connection surface 320*a* among various steps of manufacturing the inkjet head. Consequently, the polishing process never causes any removing crack and chip-off of the piezo-electric element 320. The external electrode is never cut off. Furthermore, the pressure chamber plate 310, which is made of glass, is rather strong, and thereby enables such a high polishing speed as to shorten the polishing time down to about one-fifth in comparison with conventional manufacturing methods.

The nozzle plate 330 is made of metal, e.g. stainless steel, etc. Each nozzle 332 may be formed, as described above with reference to FIG. 6, with a punch using a pin or the like, preferably into a conic shape (or as showing a tapering section) spreading from the front surface 330b toward the rear surface 330*a* of the nozzle plate 330. To obtain such a conic shaped nozzle 332 is one of the reasons why the pressure chamber plate 310 and the nozzle plate 330 are not formed in one but the nozzle plate 330 is adhered to the pressure chamber plate 310. In this embodiment, the nozzle 332 is about 80 $\mu$m in diameter at the rear surface 330*a* and about 25 through 35 $\mu$m at the front surface 330*b*. The present invention is also applicable to such an inkjet head that a nozzle thereof is formed, for example, above the pressure chamber plate 310 shown in FIG. 8, unlike the inkjet head 300.

On the surface (front surface) 330*b* of the nozzle plate 330, at least around the nozzle 332, is formed the water-repellent coating 100. Of course, the water-repellent coating 100 may be formed all over the front surface 330*b*. The water-repellent coating serves to stabilize a wiping operation, which will be described later, and to provide a high quality image. It is to be construed that the water-repellent coating should be located differently to accompany the nozzle where the nozzle of the inkjet head is formed, for example, above the pressure chamber plate 310 shown in FIG. 8.

In the inkjet head 300, each external electrode 328 independently applies a voltage the internal electrode 324 of the piezo-electric block 321, and each piezo-electric block 321 independently deforms in the direction A in FIG. 1, bending the resin film 340 in the direction A and compressing the corresponding pressure chamber 312. This compression results in jetting ink from the pressure chamber 321 through the corresponding nozzle 332. When the electrification from the external electrode 328 stops, the resin film 340 and the piezo-electric block 321 returns to the original states by discharging. At that time, the internal pressure of the pressure chamber 312 reduces and ink is supplied from the common ink chamber 316 through the ink introduction channel 314 to the pressure chamber 312.

Although this embodiment uses the piezo-electric element 320 that deforms in the longitudinal direction, but another embodiment may use one that deforms in the lateral direction. Further, the present invention is not limited to the piezo-type inkjet head employing the piezo-electric element but applicable to the bubble-type inkjet head.

Figure 10:
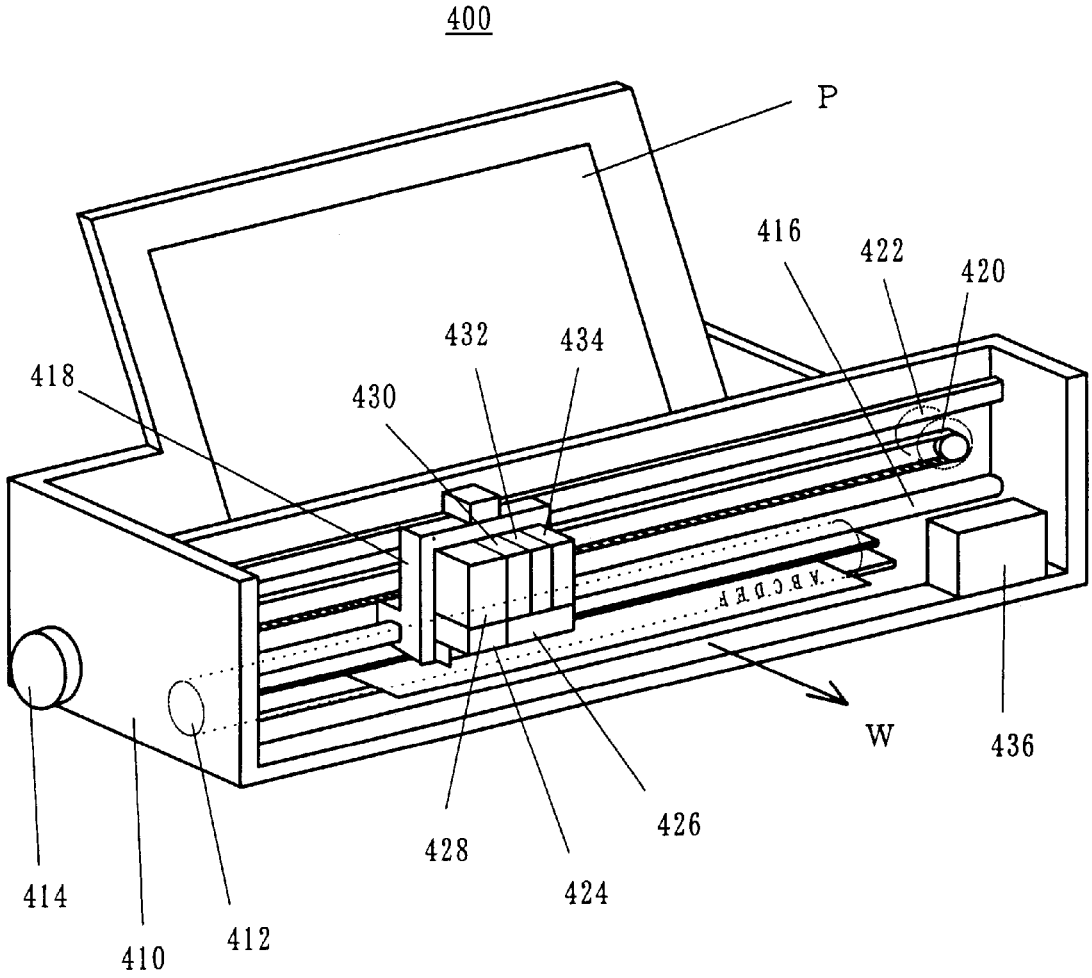
FIG. 10 is a perspective overview of a recording device according to the present invention.

Referring next to FIG. 10, a description will be given of an inkjet printer 400 provided with the inkjet head 300 of the present invention. In each drawing, those members designated by the same reference numeral denote the same members, and a duplicate description will be omitted. FIG. 10 schematically illustrates an embodiment of the color inkjet printer (recording device) 400 to which the inkjet head 300 of the present invention is applied. In a housing 410 of the recording device 400, a platen 414 is rotatably provided.

In a recording operation, the platen 412 is driven to intermittently rotate by a driving motor 414 and send recording paper P at a predetermined feed pitch in the arrow direction W. In the housing 416 of the recording device, a guide rod 416 is provided in parallel to and above the platen 412.

A carriage 418 is mounted to an endless driving belt 420 that is driven by the driving motor 422 reciprocating for scanning along the platen 412.

The carriage 412 is mounted with a black recording head 424 and a color recording head 426. The color recording head 426 may comprises three parts. The black recording head 424 is removably provided with a black ink tank 428, and the color recording head 426 is removably provided with color ink tanks 430, 432 and 434. The inkjet head 300 of the present invention is applicable to such recording heads 424 and 426.

Needless to say, the black ink tank 428 accommodates black ink and the color ink tanks 430, 432 and 434 accommodate yellow ink, cyan ink and magenta ink respectively.

While the carriage 418 reciprocates along the platen 412, the black recording head 424 and the color recording head 426 are driven based on image data received from a word processor and a personal computer, etc., predetermined characters, images and the like are recorded on recording paper P. When the recording operation is suspended, the carriage 418 is returned to its home position and this home position is provided with a nozzle maintenance mechanism (or backup unit) 436.

The nozzle maintenance mechanism 436 is provided with a movable suction cap (not shown) and a suction pump (not shown) connected to the movable suction cap. When the recording heads 224 and 226 are placed at the home position, the suction cap is adsorbed to the nozzle plate of each recording head and the nozzle of the nozzle plate is sucked. This mechanism prevents the nozzle from being plugged. After that, a wiping unit (also not shown) wipes out the nozzle plate 330*b* with a wiper. On that occasion, the water-repellent coating 100 wipes out ink on the nozzle plate surface 330*b* completely, and the hard body 108 in the water-repellent coating 100 prevents the water-repellent coating from being destroyed or otherwise.

Although the preferred embodiments of the present invention have been described above, it is to be understood that various modifications and changes may be made in the present invention without departing from the spirit and scope thereof.

According to the water-repellent coating as set forth in claim 1, the water repellency of its fluoric polymer works well serving to provide a high quality image, and its hard body enhancing the wiping resistance of the fluoric polymer guarantees to continuously provide the high quality image. According to the water-repellent coating as set forth in claim 2, its flat hard body is not so vulnerable to friction or likely to fall off compared with a spherical hard body, and therefore can keep its wiping resistance for a long time. According to the water-repellent coating as set forth in claim 3, its flat body having a big particle diameter never prevents the nozzle plate surface from being smoothly wiped. According to the water-repellent coating as set forth in claims 4 and 5, the flat hard body applicable to claim 1 is easily obtainable. The water-repellent coating as set forth in claims 6 and 7 can be easily formed without any special plating process. The recording device as set forth in claim 8 including the same water-repellent coating as claimed in claims 1 through 7 have the same effect as these claims.

The method of forming the water-repellent coating as set forth in claim 9 enables the hard body to protrude from the water-repellent coating surface; therefore, the wiping resistance of the water-repellent coating is advantageously enhanced. According to the method of forming the water-repellent coating as set forth in claim 10, the fluoric polymer melts by the heat treatment taking in the additive hard body whereby sufficient water repellency is expected even on the surface of the intrinsically low water-repellent hard body.

What is claimed is:

1. A print head comprising:

a nozzle plate including a nozzle which jets ink; and a water-repellent coating which is formed on said nozzle plate as a substrate around said nozzle and comprises a fluoric polymer formed by a plating process and a hard body protecting said fluoric polymer.

2. A print head according to claim 1 wherein said hard body has a flat shape.

3. A print head according to claim 1 wherein a major axis of a particle diameter of said hard body does not exceed 1 $\mu$m.

4. A print head according to claim 1 wherein said hard body includes a boron nitride single crystal.

5. A print head according to claim 1 wherein said hard body includes a boron carbide single crystal.

6. A print head according to claim 1 wherein an electrolytic plating process is adopted as said plating process.

7. A print head according to claim 1 wherein an electroless plating process is adopted as said plating process.

8. A recording device comprising:

a print head; and a driving device which drives said print head wherein said print head includes:

a nozzle plate including a nozzle which jets ink; and a water-repellent coating which is formed on said nozzle plate as a substrate around said nozzle and comprises a fluoric polymer formed by a plating process and a hard body protecting said fluoric polymer.

9. A method of forming a water-repellent coating comprising the steps of:

forming a resist onto a nozzle plate while partially projecting the resist from the nozzle outwardly;

performing a strike deposit via the resist;

performing a water-repellent coating containing a plated coating, a fluoric polumer and a hard body protecting said fluoric polymer via the resist; and removing the resist.

10. A method of forming a water-repellent coating according to claim 9 further comprising the step of heating said water-repellent coating until a water repellency of said water-repellent coating becomes enough to make a contact angle of ink containing 10% of alcohol 60 degrees or larger.

* * * * *